US008453865B1

(12) United States Patent
Bobier

(10) Patent No.: US 8,453,865 B1
(45) Date of Patent: Jun. 4, 2013

(54) BEVERAGE CONTAINER WITH TAMPER RESISTANT LID

(76) Inventor: Jon C. Bobier, Woodland Hills, CA (US)

( * ) Notice: Subject to any disclaimer, the term of this patent is extended or adjusted under 35 U.S.C. 154(b) by 943 days.

(21) Appl. No.: 11/517,231

(22) Filed: Sep. 7, 2006

Related U.S. Application Data

(63) Continuation-in-part of application No. 10/175,534, filed on Jun. 21, 2002, now abandoned.

(51) Int. Cl.
*B65D 41/32* (2006.01)

(52) U.S. Cl.
USPC ..... 220/266; 220/709; 220/229; 215/253; 215/388; 239/24; 239/33

(58) Field of Classification Search
USPC ..... 220/266, 229, 254.3, 709; 239/24, 239/33; 215/253, 388
See application file for complete search history.

(56) References Cited

U.S. PATENT DOCUMENTS

| | | | | |
|---|---|---|---|---|
| 584,091 | A * | 6/1897 | Leidich | 137/849 |
| 3,438,578 | A * | 4/1969 | Moyer et al. | 239/33 |
| 3,592,351 | A * | 7/1971 | Johnson et al. | 220/257.2 |
| 4,779,750 | A * | 10/1988 | Armstrong | 215/254 |
| 5,249,704 | A * | 10/1993 | Boetzkes | 220/724 |
| 6,070,748 | A * | 6/2000 | Storar | 215/249 |
| 7,021,481 | B2 * | 4/2006 | St. Germain et al. | 220/254.2 |

* cited by examiner

*Primary Examiner* — Anthony Stashick
*Assistant Examiner* — James N Smalley
(74) *Attorney, Agent, or Firm* — Kenneth L Tolar

(57) ABSTRACT

A beverage container with a tamper resistant lid includes a cylindrical reservoir with an open upper end in communication with an interior beverage compartment. Formed about the open upper end is an annular rim. The tamper resistant lid includes a circular panel with an annular lip depending therefrom. Positioned on the inwardly facing surface of the lip are a plurality of juxtaposed, inwardly-extending flanges. The flanges are flexible but resilient such that, when the lid is pressed onto the open upper end of the container, the flanges initially expand to circumvent the rim, and subsequently contract to grip the lower surface thereof to retain the lid on the container. The lid includes any one of a plurality of secure dispensing means to dispense a beverage from the beverage compartment.

9 Claims, 3 Drawing Sheets

BEVERAGE CONTAINER WITH TAMPER RESISTANT LID

CROSS REFERENCE TO RELATED APPLICATIONS

This is a continuation-in-part of application Ser. No. 10/175,534 filed on Jun. 21, 2002, now abandoned.

BACKGROUND OF THE INVENTION

The present invention relates to a beverage container with a tamper resistant lid that prevents others from surreptitiously injecting drugs and other substances into a beverage.

DESCRIPTION OF THE PRIOR ART

According to law enforcement statistics, tens of thousands of women are assaulted each year after they are unknowingly subjected to "date rape" drugs. The most common means of exposing a woman to such a drug is slipping it into a drink when the woman is distracted. Because these drugs are odorless, tasteless and colorless, they are virtually undetectable once diluted within the beverage. Recently, a few products have been developed that purportedly allow a beverage consumer to detect the presence of these drugs. For example, test strips are available that allegedly undergo a color change when dipped in a beverage containing certain contaminants. However, these tests are notoriously unreliable and often render false positive readings depending upon the original beverage ingredients. Accordingly, there is currently a need for a more effective means of preventing date rape. The present invention addresses this problem by providing a uniquely designed beverage container having a tamper-resistant lid that prevents another from accessing the container's contents.

SUMMARY OF THE INVENTION

The present invention relates to a beverage container with a tamper resistant lid including a cylindrical reservoir with an open upper end in communication with an interior beverage compartment. Formed about the periphery of the open upper end is an annular rim. The tamper resistant lid includes a circular panel with an annular lip depending therefrom. Positioned on the inwardly facing surface of the lip are a plurality of juxtaposed, inwardly-extending flanges. The flanges are flexible but resilient such that, when the lid is pressed onto the open upper end of the container, the flanges initially expand to circumvent the rim, and subsequently contract to grip the lower surface thereof to retain the lid on the container. The lid includes any one of a plurality of secure dispensing means to dispense a beverage from the beverage compartment.

It is therefore an object of the present invention to provide a beverage container having a tamper resistant lid.

It is another object of the present invention to provide a beverage container that prevents date rape drugs and other substances from being slipped into one's beverage.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
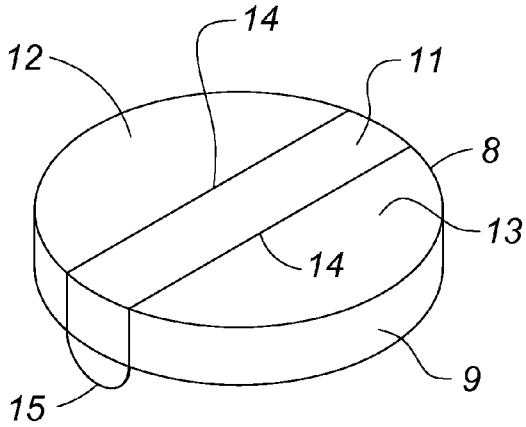
FIG. 2 is a perspective view of the tamper resistant lid.
Figure 1:
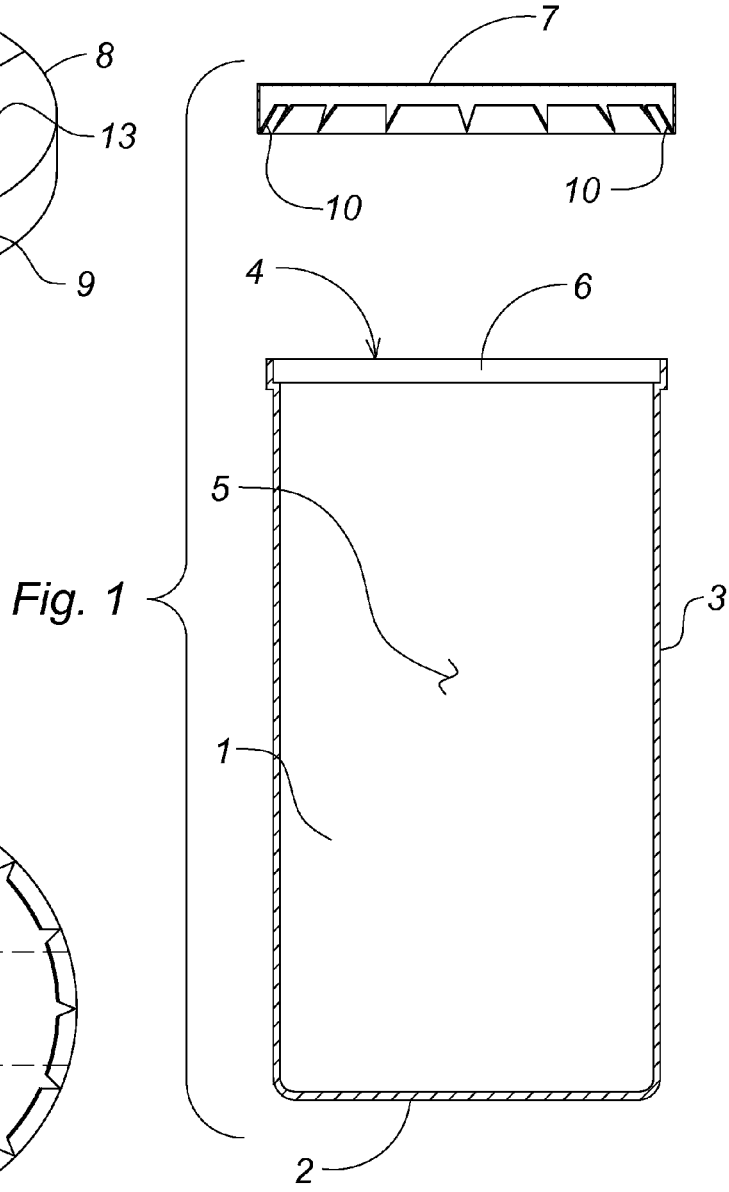
FIG. 1 is a plan, cross-sectional view of the beverage container.
Figure 3:
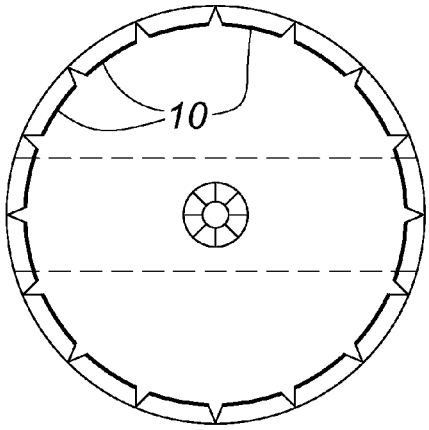
FIG. 3 is a bottom view of the tamper resistant lid.
Figure 4:
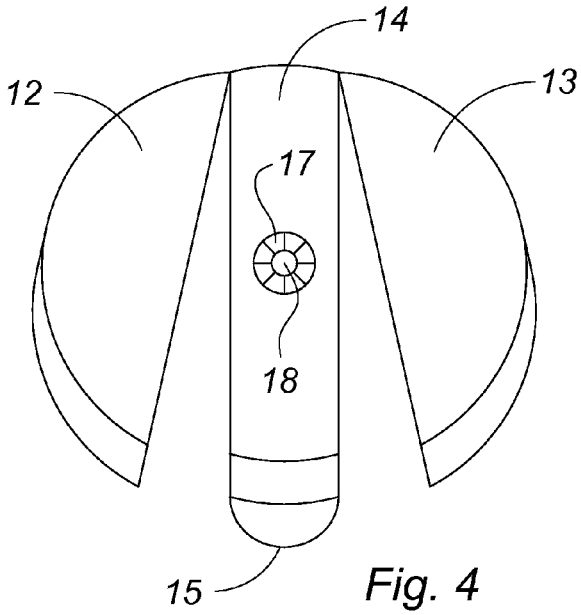
FIG. 4 depicts the lid separating into multiple components for removal.
Figure 5:
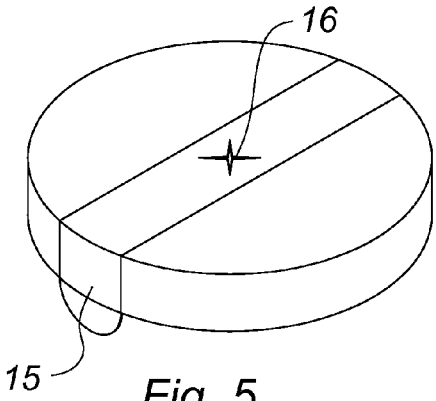
FIG. 5 is perspective view having a dispensing means according to a first embodiment of the present invention.

The present invention relates to a beverage container having a tamper resistant lid. The device comprises a substantially cylindrical beverage reservoir 1 having a closed lower end 2, a continuous cylindrical outer wall 3 extending upwardly therefrom and an open top 4 in communication with an interior beverage compartment 5. Formed about the outer wall of the container, at the upper end, is an annular rim 6.

The device also includes a tamper-resistant lid 7 that is secured over the upper end of the reservoir to prevent tampering with a beverage received within the beverage compartment. The lid includes a circular plate 8 with an annular lip 9 perpendicularly depending therefrom. Positioned on an inwardly facing surface of the lip are a plurality of juxtaposed gripping flanges 10 that extend upwardly and inwardly towards the plate's central axis. The flanges are flexible but resilient so that, when the lid is depressed, the flanges initially spread to circumvent the rim and subsequently contract to tightly engage a lower side thereof. Once the flanges are positioned beneath the rim, any attempt to forcefully remove the lid will substantially destroy it.

The lid also includes a release means that allows a dishwasher or bartender to easily remove the lid once the beverage has been consumed. The lid is formed of three separable sections including a central portion 11 and two opposing side portions 12,13. Each side portion is joined to a side edge of the central portion by a frangible seam 14 that allows the three sections to be separated with a predetermined amount of force. A thumb tab 15 depends from an end of the central portion that extends downwardly along the beverage reservoir outer wall when the lid is appropriately mounted. Accordingly, a bartender, dishwasher or the beverage consumer can easily release the lid by grasping the thumb tab and pulling upwardly thereby separating the three sections. Furthermore, the pressure that the flanges exert on the two side portions will cause the side portions to flare outwardly thereby overtly alerting the consumer that someone has tampered with the lid.

Now referring generally to FIGS. 5-12, any one of a plurality of dispensing means may be employed. A first embodiment is disclosed specifically in FIG. 5, wherein the dispensing means includes a pair of intersecting slits 16 formed on the lid for receiving a conventional straw.

Figure 6:
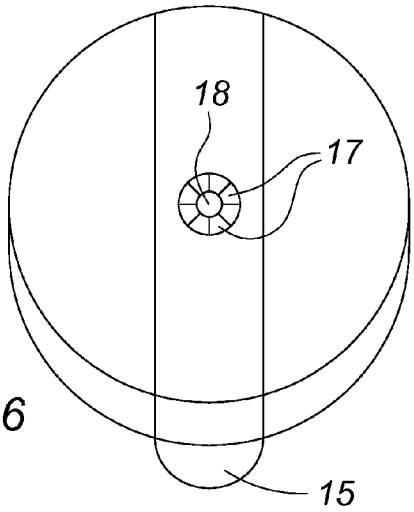
FIG. 6 is a perspective view of the lid according to a second dispensing means according to a second embodiment of the present invention.

Referring specifically to FIG. 6, the straw receptacle may be formed of downwardly extending flexible flaps 17 that are arranged to form a circular opening 18 for receiving the straw. The diameter of the opening is slightly less than the diameter of a conventional straw whereby the flaps are forced downwardly when a straw is forced into the opening. The flaps then form a larger opening and tightly grip the straw exterior to form a tight seal therebetween.

Figure 7:
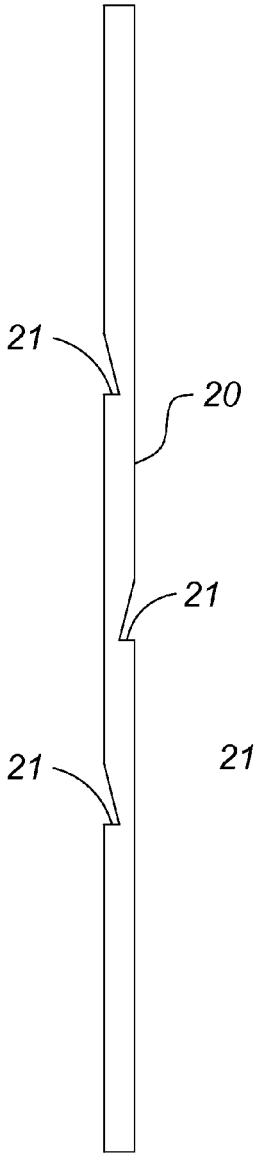
FIG. 7 is a front, plan view of a first straw design according to the present invention.
Figure 8:
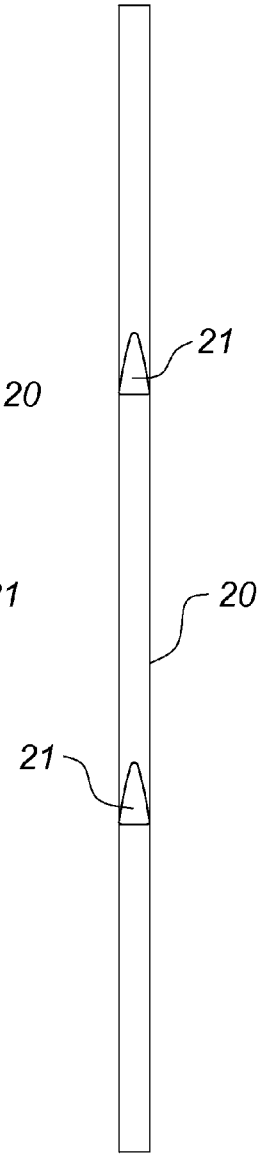
FIG. 8 is a side view of the straw depicted in FIG. 7.
Figure 9:
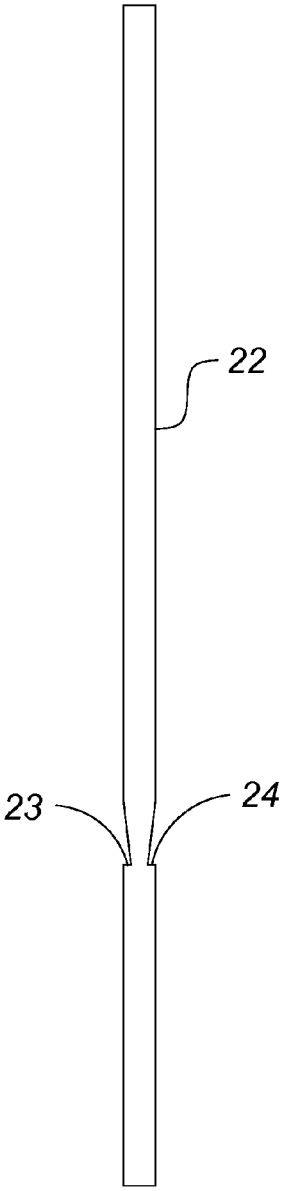
FIG. 9 is a sectional view of a second straw design according to the present invention

Now referring to FIGS. 7-9, a newly designed straw 20 may be employed, which includes notches 21 formed on the outer surface thereof. Preferably, the notches are alternately positioned on each of two opposing sides of the straw. The notches create reduced-diameter, restricted flow areas within the straw interior to obstruct the flow of substances from the straw to the beverage compartment. Accordingly, if a stranger injects a substance into the straw, a minimal amount of the substance, if any, will actually reach the beverage compartment.

As depicted in FIG. 9, a second straw design 22 includes a single indention 23 formed about the entire periphery of the straw, preferably proximal the lower end thereof. The indention results in a reduced straw diameter that approaches that of the circular opening and forms a stop member 24 immediately below. The diameter of the stop member is approximately identical to that of the straw. Accordingly, if an unauthorized person removes the straw, the flaps will briefly contract to their original orientation as the indention passes therethrough. As the stop member subsequently passes, it lifts the contracted flaps upwardly causing them to bend, break or otherwise become noticeably damaged to alert the user of possible tampering.

Figure 10:
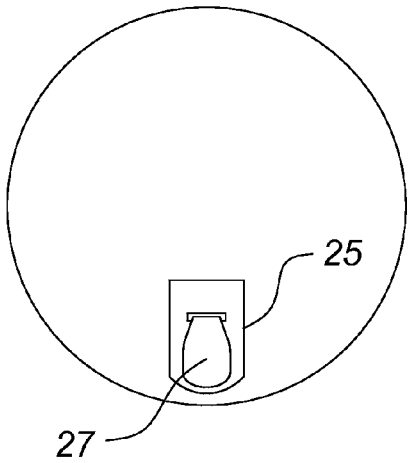
FIG. 10 is a top view of the lid with a dispensing means according to a third embodiment according to the present invention.
Figure 11:
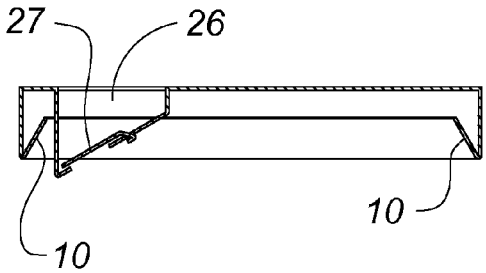
FIG. 11 is a side, sectional view of the lid depicted in FIG. 9.
Figure 12:
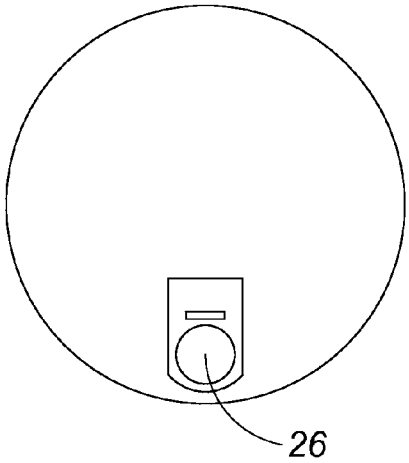
FIG. 12 is a top view of the lid of FIGS. 10 and 11 with the flap removed therefrom.

Now referring to FIGS. 10-12, in lieu of a straw, the lid may include a dispensing spout 25 formed of a recessed opening 26 positioned on the circular panel. A pivotal flap 27 is superimposed onto the dispensing opening such that when the beverage reservoir is inverted, the flap opens to release the beverage.

The above described device is not limited to the exact details of construction provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A beverage container having a tamper-resistant lid comprising:

a reservoir having a closed lower end, an outer wall extending upwardly therefrom and an open top in communication with an interior beverage compartment;

a rim formed about the outer wall of the reservoir, proximal the upper end;

a tamper-resistant lid including a plate with a lip depending therefrom, said lid including a central portion and two opposing side portions, each side portion joined to a side edge of the central portion by a frangible seam that allows each side section to be separated from the central portion with a predetermined amount of force;

a plurality of juxtaposed gripping flanges positioned on an inwardly facing surface of the lip that engage a lower surface of said rim when said lid is pressed onto the upper end of said reservoir to secure said lid thereto;

a straw receptacle on said lid, said receptacle formed of downwardly-extending flexible flaps that are arranged to form a circular opening for receiving a straw;

a straw having a predetermined diameter and an outer surface with an indention formed about an entire periphery thereof, said indention forming a reduced diameter portion and a stop member immediately below, a diameter of the stop member being approximately identical to the predetermined diameter of said straw whereby lifting the straw causes the stop member to lift the flaps upwardly causing damage thereto to alert a user of possible tampering.

2. The beverage container according to claim 1 wherein said flanges extend upwardly and inwardly towards a central axis of said lid, said flanges being flexible but resilient so that, when the lid is depressed, the flanges initially spread to circumvent the rim and subsequently contract to tightly engage the lower surface thereof.

3. The beverage container according to claim 1 wherein said lid includes a thumb tab depending from an end of the central portion that extends downwardly along the outer wall of said beverage reservoir allowing a user to easily release the lid by grasping the thumb tab and pulling upwardly thereby separating the side sections from said central section.

4. A beverage container having a tamper resistant lid comprising:

a reservoir having a closed lower end, an outer wall extending upwardly therefrom and an open top in communication with an interior beverage compartment;

a rim formed about the outer wall of the reservoir, proximal the upper end;

a tamper-resistant lid including a plate with a lip depending therefrom, said lid including a central portion and two opposing side portions, each side portion joined to a side edge of the central portion by a frangible seam that allows each side section to be separated from the central portion with a predetermined amount of force;

a plurality of juxtaposed gripping flanges positioned on an inwardly facing surface of the lip that engage a lower surface of said rim when said lid is pressed onto the upper end of said reservoir to secure said lid thereto;

a dispensing spout formed of a recessed opening positioned on the lid, said recessed opening having a pivotal flap superimposed thereon such that when the beverage reservoir is inverted, the flap opens to release the beverage.

5. The beverage container according to claim 4 wherein said flanges extend upwardly and inwardly towards a central axis of said lid, said flanges being flexible but resilient so that, when the lid is depressed, the flanges initially spread to circumvent the rim and subsequently contract to tightly engage the lower surface thereof.

6. The beverage container according to claim 4 wherein said lid includes a thumb tab depending from an end of the central portion that extends downwardly along the outer wall of said beverage reservoir allowing a user to easily release the lid by grasping the thumb tab and pulling upwardly thereby separating the side sections from said central section.

7. A beverage container having a tamper-resistant lid comprising:

a reservoir having a closed lower end, an outer wall extending upwardly therefrom and an open top in communication with an interior beverage compartment;

a rim formed about the outer wall of the reservoir, proximal the upper end;

a tamper-resistant lid including a plate with a lip depending therefrom, said lid including a central portion and two opposing side portions, each side portion joined to a side edge of the central portion by a frangible seam that allows each side section to be separated from the central portion with a predetermined amount of force;

a plurality of juxtaposed gripping flanges positioned on an inwardly facing surface of the lip that engage a lower surface of said rim when said lid is pressed onto the upper end of said reservoir to secure said lid thereto, wherein said flanges extend upwardly and inwardly towards a central axis of said lid, said flanges being flexible but resilient so that, when the lid is depressed, the flanges initially spread to circumvent the rim and subsequently contract to tightly engage the lower surface thereof;

a straw receptacle on said lid;

a straw received within said receptacle, said straw including an interior, and an outer surface with notches thereon, said notches creating reduced-diameter, restricted flow areas within the straw interior to obstruct flow of substances from the straw interior to the beverage compartment.

8. The beverage container according to claim 7 wherein said notches are alternately positioned on each of two opposing sides of the straw.

9. The beverage container according to claim 7 wherein said lid includes a thumb tab depending from an end of the central portion that extends downwardly along the outer wall of said beverage reservoir allowing a user to easily release the lid by grasping the thumb tab and pulling upwardly thereby separating the side sections from said central section.

* * * * *